US005845835A

United States Patent [19]

Kim

[11] Patent Number: 5,845,835

[45] Date of Patent: Dec. 8, 1998

[54] TAG PIN ATTACHER

[76] Inventor: Choonsun Kim, 998-2, Shinjung-4 Dong, Kangsu-ku, Seoul, Rep. of Korea

[21] Appl. No.: 903,951

[22] Filed: Jul. 31, 1997

[30] Foreign Application Priority Data

Aug. 9, 1996 [KR] Rep. of Korea ..... 96-33160

[51] Int. Cl.[6] ..... B25C 1/00; B65C 5/06

[52] U.S. Cl. ..... 227/67; 227/113

[58] Field of Search ..... 227/67, 68, 71, 227/113, 109, 119, 156

[56] References Cited

U.S. PATENT DOCUMENTS

| | | | |
|---|---|---|---|
| 4,339,065 | 7/1982 | Haytayan | 227/113 |
| 4,389,012 | 6/1983 | Grikis et al. | 227/113 |
| 4,465,217 | 8/1984 | Furutsu | 227/67 |
| 4,789,091 | 12/1988 | Randolph | 227/67 |
| 4,969,589 | 11/1990 | Kim | 227/67 |
| 5,639,006 | 6/1997 | Kim | 227/67 |

FOREIGN PATENT DOCUMENTS

| | | |
|---|---|---|
| 2098913 | 12/1982 | United Kingdom . |
| 2293566 | 4/1996 | United Kingdom . |

*Primary Examiner*—Scott A. Smith
*Attorney, Agent, or Firm*—Foley & Lardner

[57] ABSTRACT

Disclosed is a tag pin attacher. The tag pin attacher includes an elevating plate disposed in a cavity in one of two sections of a casing. Also, a finger member is mounted able to move forward and backward on the elevating plate to feed tag pins for extrusion, the elevating plate being moved up and down by rectilinear movement of an interconnector moving by operation of a trigger. Further provided is a guide rail part formed in the cavity of the casing, the guide rails guiding the up and down movement of the elevating plate, a pair of magnets formed on each of the guide rails at differing heights, and a magnetic protrusion member formed at a predetermined position on the finger member such that the same can undergo a forward and reverse movement by being attracted to different magnets of the guide rails with the up and down movement of the elevating plate.

3 Claims, 8 Drawing Sheets

TAG PIN ATTACHER

FIELD OF THE INVENTION

The present invention relates to a tag pin attacher and, more particularly, to a tag pin attacher used to attach tag pins on apparel, shoes, etc. which can individually extrude the tag pins when a large number of the same of a narrow pitch are charged in the attacher.

BACKGROUND OF THE INVENTION

A tag pin attacher affixes a tag pin T, shown in FIG. 5, on apparel, shoes, etc. The tag pin T includes a head H, a rod R extended from the head H and by which a tag (not shown) is suspended, and a stopper S formed perpendicular to the rod R at an end of the same opposite that to which the head H is formed. Referring to FIG. 6, a plurality of tag pins T are formed in a string by injection molding. The tag pins T are integrally formed on a base B with cutting parts C bridging between the tag pins T and the base B.

The tag pin T structured as in the above is extruded through a hollow needle of a tag pin attacher to affix the tag pin T to apparel, shoes, etc. That is, a user sticks an object such as apparel or shoes with the hollow needle via a hole provided on the tag and pulls a trigger of the tag pin attacher. The stopper S of the tag pin T is extruded to an opposite side of the object such that the tag is suspended on the rod R between the object and the head H and the tag pin is affixed to the object. Here, the cutting part C of the tag pin T is cut by a cutter provided on the hollow needle while the stopper S is extruded through the hollow needle such that the tag pin T is separated from the base B.

The conventional tag pin attacher for suspending a tag from an object as described above includes a charge mechanism for feeding the tag pin T to a position where the same is extruded by hooking and pulling the tag pin T at the cutting part C, an extrusion mechanism for axially pushing the stopper S of the tag pin T and for extruding the same through the hollow needle, and a trigger mechanism for operating the extrusion mechanism.

Conventional charge mechanisms are divided into a sprocket type and a hook type.

U.S. Pat. No. 4,969,589 discloses a sprocket type feed mechanism which is advantageous in that it has a simple structure and that the tag pins are fed well. However, it has a drawback in that a pitch of the sprocket must correspond to intervals of the tag pins arranged on the base.

As a result, because the tag pins T are arranged on the base B as shown in FIG. 6, limitations of the length of the base D and the intervals of the tag pins T restrict the number of tag pins T that can be provided on the base D. Although it is possible to form 80 to 100 tag pins T on one base B, the base B of the string of tag pins T for use in the sprocket type feed mechanism can not exceed 50 tag pins T such that the user must frequently supply new strings of tag pins T to the charge mechanism.

Hook type mechanisms are advantageous in that they allow a string of tag pins of narrow pitch to be charged in the tag pin attacher.

Among the hook type feed mechanisms, there is one type in which the tag pins are fed by a two-stepped movement, i.e., an upward-downward movement of the hook, and another type in which the tag pins are fed by a four-stepped movement, i.e., a forward-downward-backward-upward movement of the hook. The former, the two-stepped, is advantageous in that it can be performed by a tag pin attacher having a simple structure. However, it is possible for the tag pin to become disengaged during a downward movement of the hook.

Korean Patent Application No. 94-25211, filed by the present inventor, discloses a tag pin attacher using the hook type feed mechanism in which the tag pins are fed using the four-stepped movement. In the above tag pin attacher, the hook is mounted on an ascent/descent plate such that it performs a forward/reverse movement parallel to the extrusion direction of the tag pin. A swing lever is interposed between the hook and ascent/descent plate such that the forward-reverse movement of the hook is controlled according to the position of the ascent/descent plate.

As the trigger is operated by the user, the ascent/descent plate moves perpendicular to the extruding direction of the tag pin through a linkage, performing a rectilinear movement. Namely, when the trigger is operated, the linkage moves in a forward direction which raises the ascent/descent plate to a groove and, at the same time, activates the swing lever to move the hook in the reverse direction. When the forward movement of the linkage is completed, the linkage strikes the hook to move the same forward. Further, when the linkage moves in the reverse direction, the ascent/descent plate comes to descend such that the hook cuts the cutting portion of tag pin and the same is fed to the extrusion position.

In the above tag pin attacher, a large number of parts is needed to allow the intricate simultaneous movement of the ascent/descent plate and hook. As a result, overall manufacturing costs of the tag pin attacher are increased and the structure of the same is made complicated.

SUMMARY OF THE INVENTION

The present invention has been made in an effort to solve the above problems.

It is an object of the present invention to provide a tag pin attacher which uses magnets for a four-stepped movement of a finger member, thereby reducing the number of parts used in the attacher to simplify a structure of the same such that production costs are reduced and the manufacturing process is made easy.

To achieve the above object, the present invention provides a tag pin attacher. The tag pin attacher includes an elevating plate disposed in a cavity in one of two sections of a casing; a finger member mounted able to move forward and backward on the elevating plate to feed tag pins for extrusion, the elevating plate being moved up and down by rectilinear movement of an interconnector moving by operation of a trigger; a guide rail part formed in the cavity of the casing, the guide rails guiding the up and down movement of the elevating plate; a pair of magnets formed on each of the guide rails at differing heights; and a magnetic protrusion member formed at a predetermined position on the finger member such that the same can undergo a forward and reverse movement by being attracted to different magnets of the guide rails with the up and down movement of the elevating plate.

In another aspect, a magnetic protrusion member comprises a pair of magnetic protrusions formed on the finger member at differing positions along a longitudinal direction thereon.

Also, the guide rail part comprises at least one guide rail formed in the cavity of the casing, the guide rail having formed a pair of magnets at differing positions along a longitudinal direction thereon.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
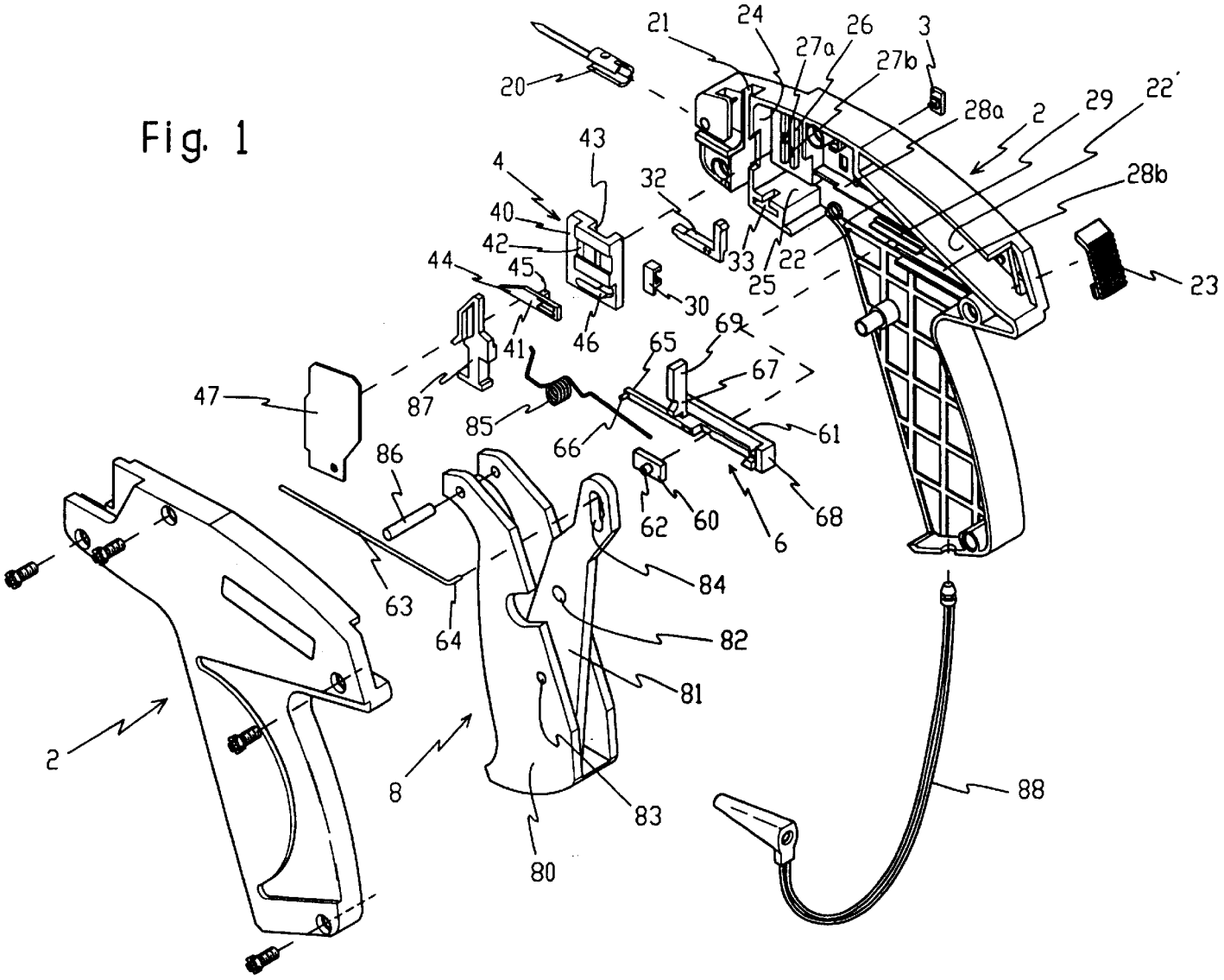
FIG. 1 is an exploded perspective view of a tag pin attacher according to a preferred embodiment of the present invention.

Referring to FIG. 1, reference numeral 2 denotes a casing formed in two separate sections, 4 a tag pin feed mechanism, 6 an extrusion mechanism, and 8 a trigger mechanism. The tag pin feed mechanism 4, the extrusion mechanism 6, and the trigger mechanism 8 are received at predetermined positions within the casing 2.

Figure 6:
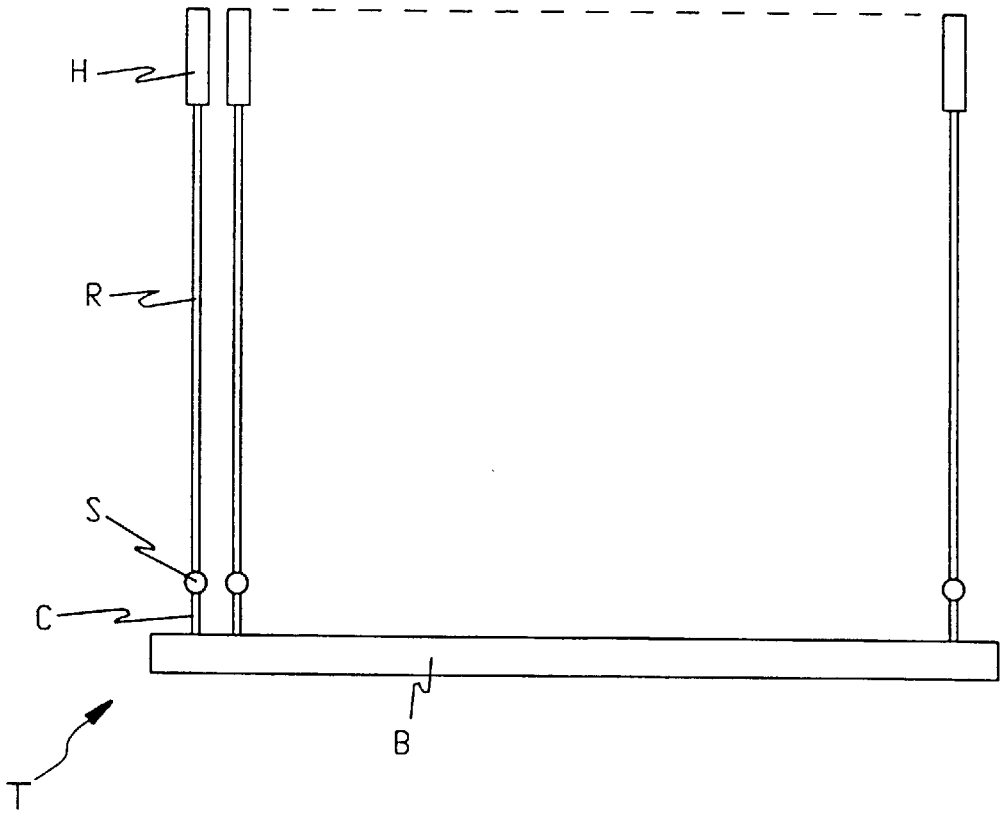
Fig. 6 PRIOR ART
FIG. 6 is a side view of a string of tag pins shown in FIG. 5.

As in the prior art tag pin attacher, a hollow needle 20 is inserted and fixed to a front of the tag pin attacher, and a slot 21, into which a base B of a string of tag pins T shown in FIG. 6 is inserted, is formed perpendicular to the insertion direction of the hollow needle 20. The majority of the slot 21 is formed on one of the two sections of the casing 2.

A vacancy 22' is provided at an upper rear portion of the casing 2, the vacancy 22' being defined by a partition 22 and a wall of the casing 2. The vacancy 22' is capped by a lid 23 which can be opened and closed to store the hollow needle 20 when the tag pin attacher is not in use.

A cavity 25 is formed adjacent to the slot 21 by being divided from the same by a wall 24. A pair of guide rails 26 is integrally provided on the casing 2 at approximately a center portion of the cavity 25. The guide rails 26 are formed substantially parallel to one another, each guide rail 26 having a magnet 27*a* and 27*b* fixed thereon.

A pair of horizontal walls 28*a* and 28*b* is formed beneath the partition 22 and to the rear of the cavity 25. A guide 29 is provided between the horizontal walls 28*a* and 28*b*.

A latch 30, which can move up and down, is provided above the upper horizontal wall 28*a* in the cavity 25. The latch 30 is mounted such that it slides on a bar 32 which moves up and down by a knob 31 mounted to an outside of the casing 2.

The tag pin feed mechanism 4 includes an elevating plate 40 which undergoes up and down movement on the guide rails 26 in the cavity 25.

The elevating plate 40 has a passage groove 42 for limiting a back and forth movement of a finger member 41 which feeds the tag pins T (shown in FIG. 6) to an extruding position. A channel 43 is formed at a location corresponding to the guide rails 26 such that the same are positioned inside the channel 43. The above finger member 41 includes an edged portion 44 for hooking and pulling the cutting part C of the tag pin T shown in FIG. 6, and a magnetic protrusion 45 integrally formed on one side of the finger member 41. The magnetic protrusion 45 extends into the channel 43 of the elevating plate 40 such that it is positioned between at one of the two magnets 27*a* and 27*b* formed on the guide rails 26. The elevating plate 40 also includes a cam groove 46 beneath the passage groove 42.

Figure 2:
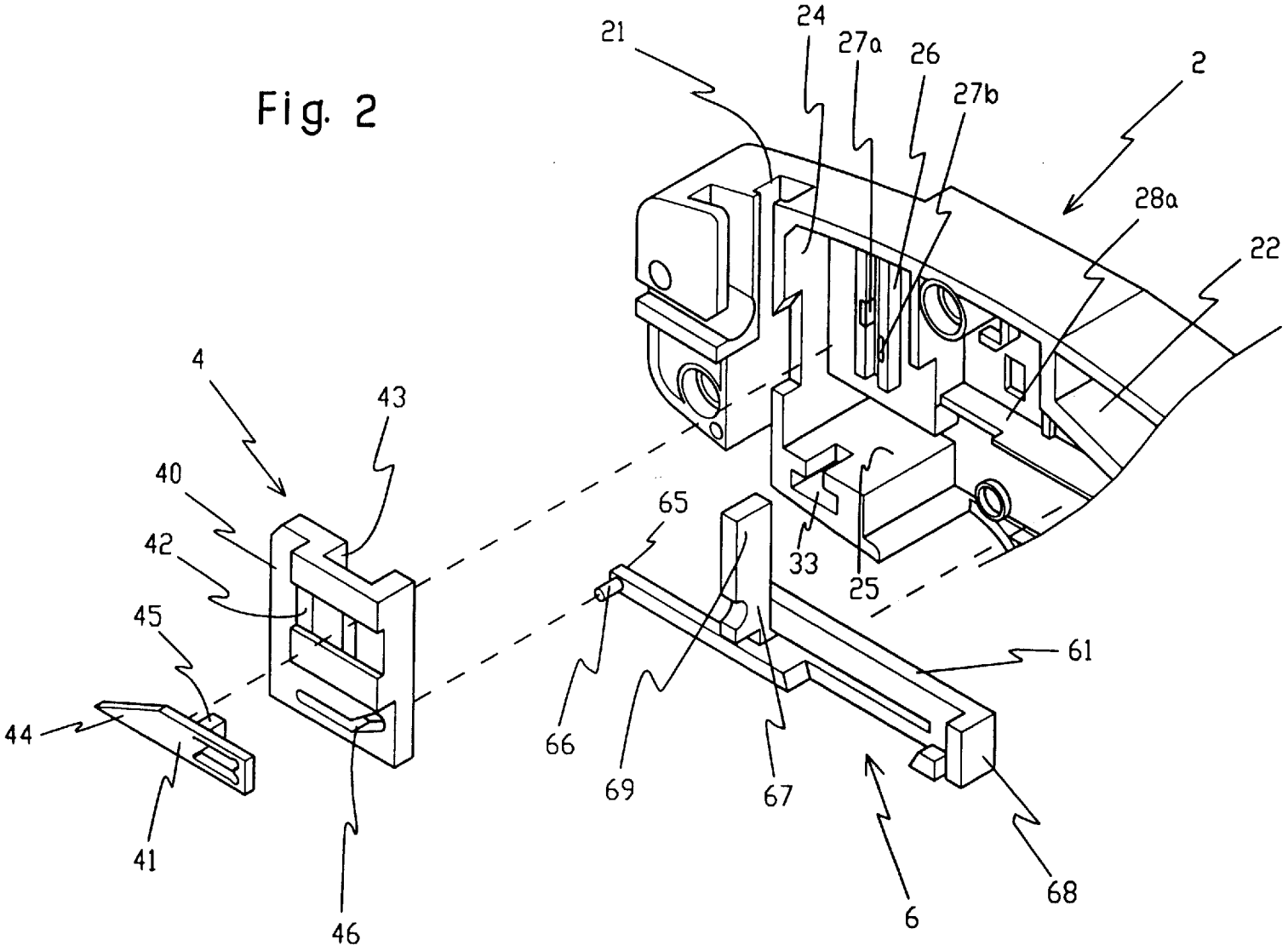
FIG. 2 is an enlarged perspective view illustrating a tag pin feed mechanism and an extrusion mechanism adopted for the tag pin attacher shown in FIG. 1.

Referring now to FIG. 2, there is shown an enlarged perspective view illustrating the tag pin feed mechanism 4. As shown in the drawing, the two magnets 27*a* and 27*b* are mounted on the guide rails 26 not parallel to one another but split on upper and lower positions thereof. That is, the magnet 27*a* is positioned on one guide rail 26 such that it corresponds to a location of the magnetic protrusion 45 formed on the finger member 41 when the elevating plate 40 is in a raised state, while the magnet 27*b* corresponds to the location of the magnetic protrusion 45 when the elevating plate 40 is in a downward state. A cover 47 (shown in FIG. 1) is placed over the tag pin feeding mechanism 4 to maintain all the parts of the same and related parts in a compact state.

Referring back to FIG. 1, the extrusion mechanism 6 includes a slider 60 and a interconnector 61 which moves on the slider 60. A hollow extension 62 is formed at a center part of the slider 60 to allow insertion of a bend 64 of an extrusion rod 63 used to push the stopper S of the tag pin T shown in FIG. 6.

Also, an arm 65 is integrally formed extending on a front of the interconnector 61 and a cam projection 66 is formed on a front end of the arm 65 for insertion into the cam groove 46 of the elevating plate 40. A yoke 67 is integrally provided adjacent to the arm 65. There is further provided a stopper 68 on a side of the extrusion mechanism 6 opposite that to which the cam projection 66 is formed.

The extrusion rod 63 is positioned in the yoke 67 such that the extrusion rod 63 moves smoothly in a straight line when the same is moved forward and backward by the slider 60.

A pusher 69 is formed extending above the yoke 67 such that when the interconnector 61 moves forward, the pusher 69 strikes against a back part of the finger member 41 to move the same forward. Here, it is not necessary that the pusher 69 be formed on the extrusion mechanism 6 and it is possible to form the yoke 67 to perform this operation.

The stopper 68 and the yoke 67 act to define a stroke range of the slider 60.

The trigger mechanism 8, as in the prior art tag pin attacher, has a trigger 80 and a lever 81 having an end pivoted on the trigger 80. The lever 81 has two hinge holes 82 and 83 located at a middle and a lower end thereof, respectively, and a slot 84 at an upper end thereof. The middle hinge hole 82 is hinged on the casing 2, the lower hinge hole 83 is hinged on the trigger 80 by a pin etc., and the trigger 80 is hinged on the casing 2 with a return spring 85 interposed therebetween and a support pin 86 fixing the return spring 85 to the trigger 80.

A checker 87 is disposed behind the slot 21 in the casing 2 by being inserted in an insertion groove 33 provided under the cavity 25. The checker 87 is continuously engaged with the cutting-part C of the tag pins T, shown in FIG. 6, charged in the slot 21 such that tag pins T do not slip out of the slot 21.

Reference numeral 88 in FIG. 1, not yet described, denotes a protector inserted in the hollow needle 20.

Figure 3A:
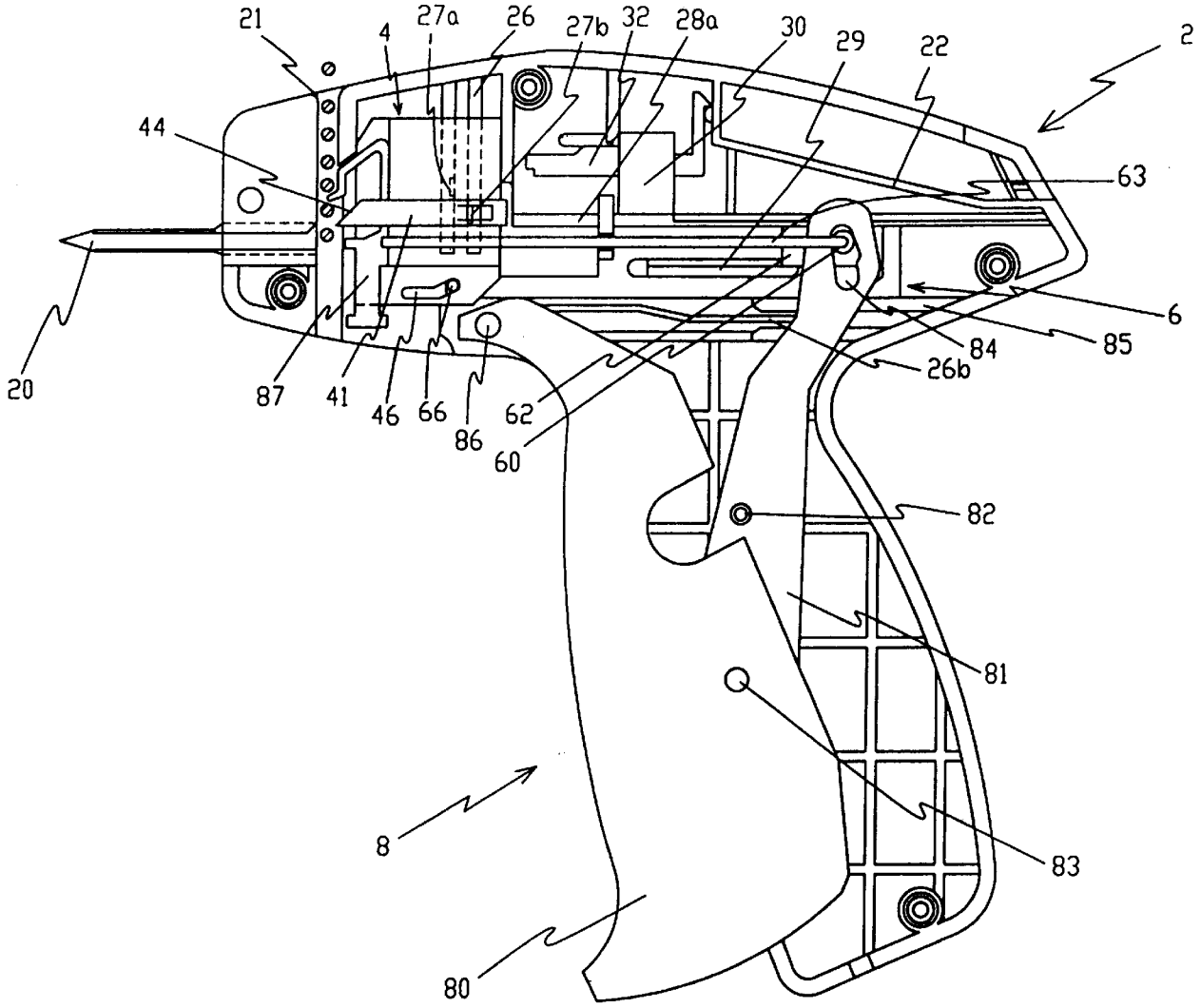
FIG. 3A is a partial enlarged view of the tag pin attacher shown in FIG. 1 in a state before a trigger is operated.
Figure 3B:
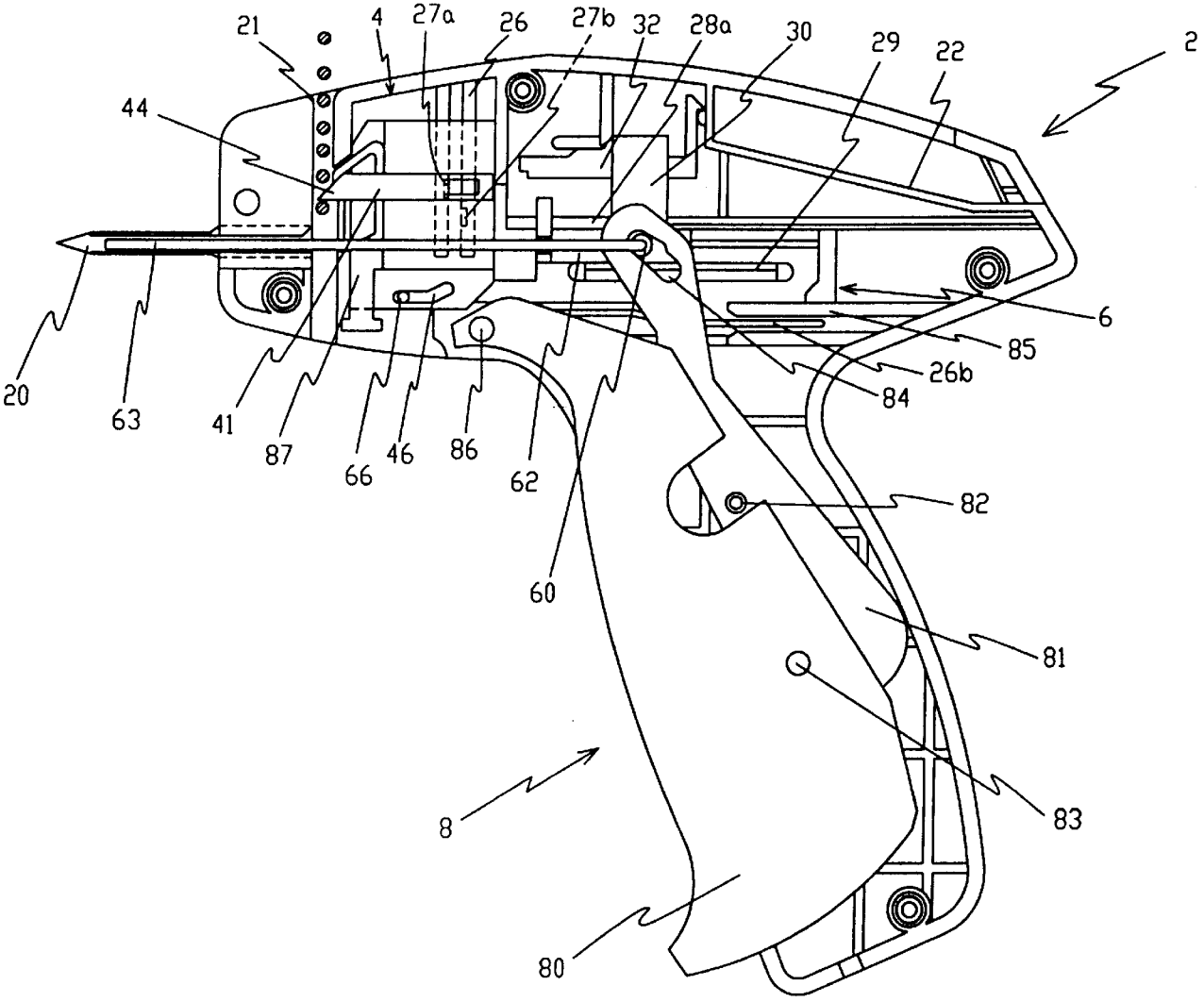
FIG. 3B is a partial enlarged view of the tag pin attacher shown in FIG. 1 in a state in which the trigger is partly engaged.
Figure 3C:
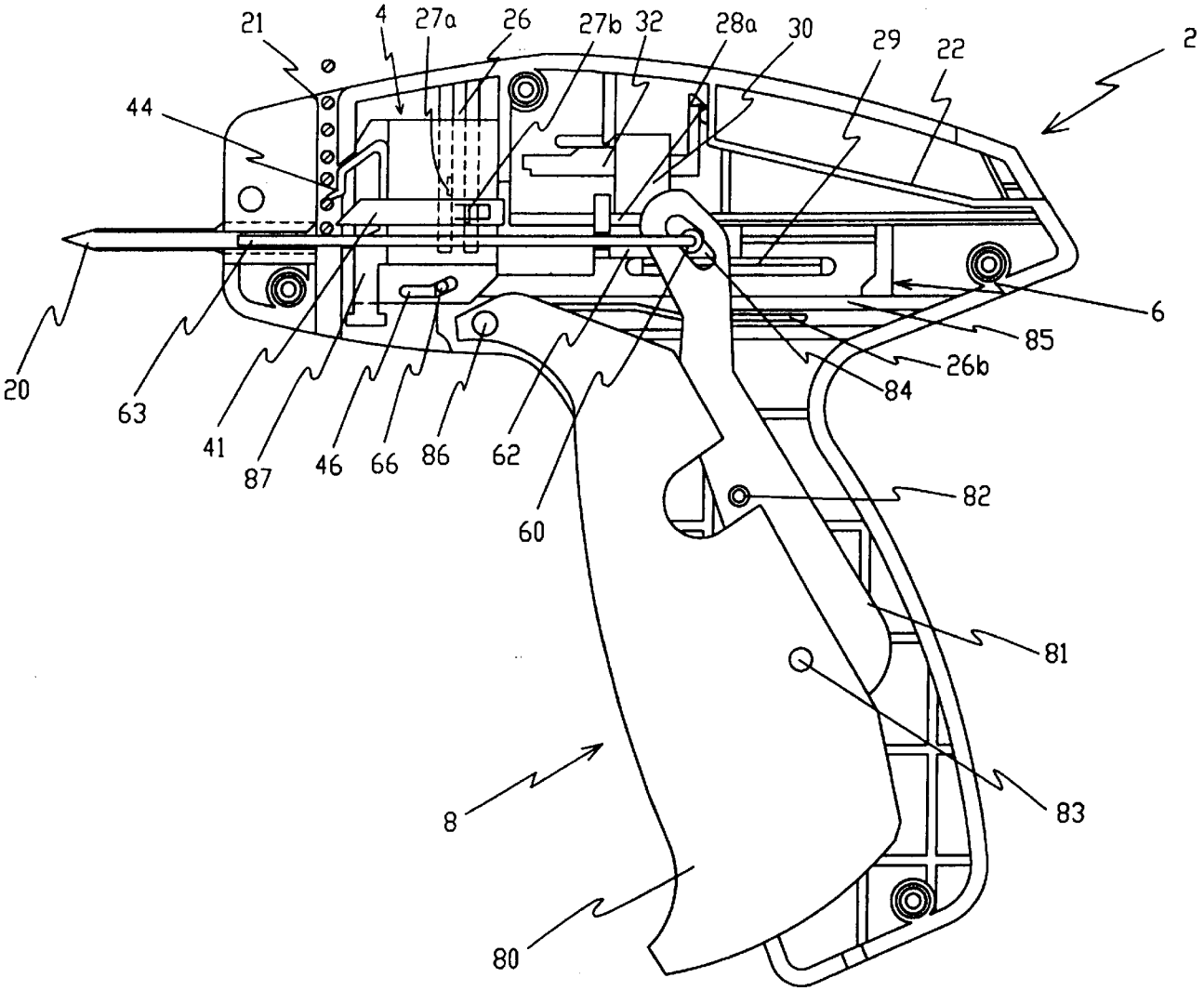
FIG. 3C is a partial enlarged view of the tag pin attacher shown in FIG. 1 in a state in which the trigger is fully engaged.

The extrusion process of the tag pins T by the tag pin attacher having the aforementioned structure is illustrated in FIGS. 3A through 3C.

At an initial state of the operation shown in FIG. 3A, the interconnector 61 is maintained at a rearward position by the return spring 85. Accordingly, the cam projection 66 is located at an upper end of the cam groove 46 such that the elevating plate 40 is located at a low position. Here, the magnetic protrusion 45 of the finger member 41 is attracted by the magnetic force of the lower magnet 27*b* such that the finger member 41 is at a rearward position. In such a state, the edged portion 44 of the finger member 41 is located slightly detached from the cutting portion C of the lowest tag pin T. Here, the tag pins T are maintained securely in their positions in the slot 21 by the checker 87.

When the user pulls the trigger 80 as shown in FIG. 3B, the lever 81 moves the slider 60. The slider 60 then abuts against the yoke 67 of the interconnector 61 and pushes the yoke 67 forward. As a result, the cam projection 66 of the arm 65 is also pushed forward such that the elevating plate 40 is located at an upward position. When this happens, the magnetic protrusion 45 of the finger member 41 is detached from the lower magnet 27*b* and is raised together with the elevating plate 40. At this state, the extrusion rod 63 passes through the hollow needle 20 such that the lowest tag pin T is almost extruded through the hollow needle 20.

Referring to FIG. 3C, as the trigger 80 is completely pulled, the slider 60 pushes the interconnector 61 such that the same is located at a furthermost forward position. As a result, the cam projection 66 of the interconnector 61 undergoes a cam movement in the cam groove 46, raising the elevating plate 40. When the elevating plate 40 is in a raised position, the magnetic protrusion 45 of the finger member 41 comes to be located at the upper magnet 27*a*. Accordingly, the edged portion 44 of the finger member 41 is engaged with the cutting part C of the second tag pin T, and the extrusion rod 63 completely penetrates the hollow needle 20 to extrude the tag pin T.

After the hollow needle 20 is stung through the object on which the tag is to be attached, the tag pin T is extruded through the hollow needle 20 through the above operation and becomes suspended from the object.

Figure 4:
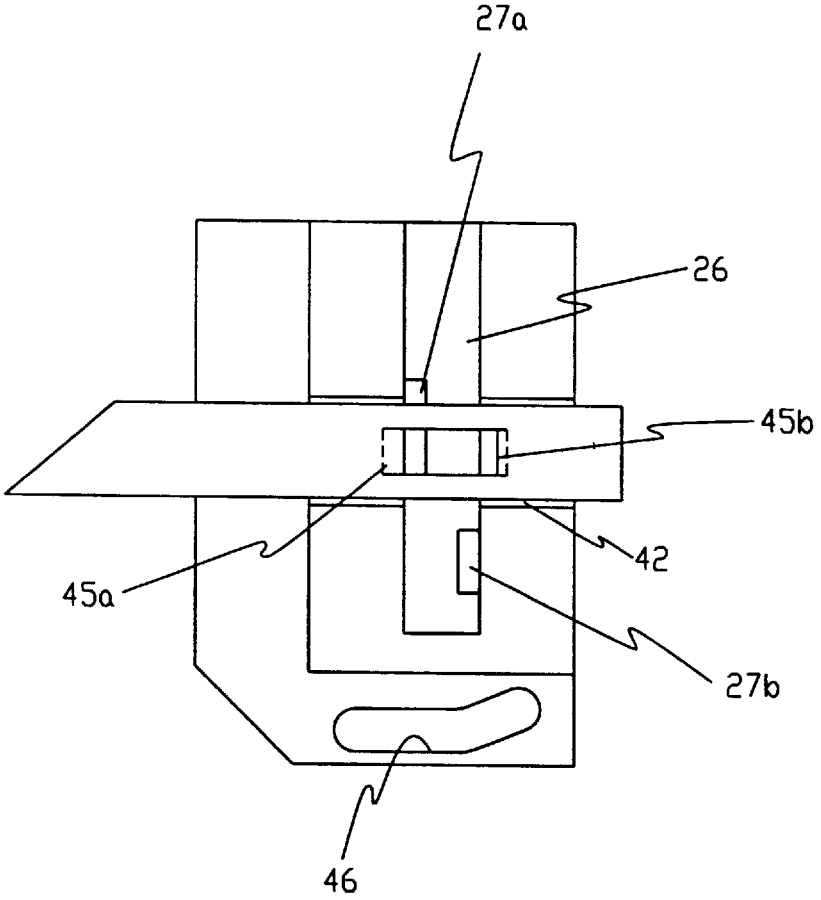
FIG. 4 is a side view illustrating a main part of a tag pin attacher according to another preferred embodiment of the present invention.
Figure 5:
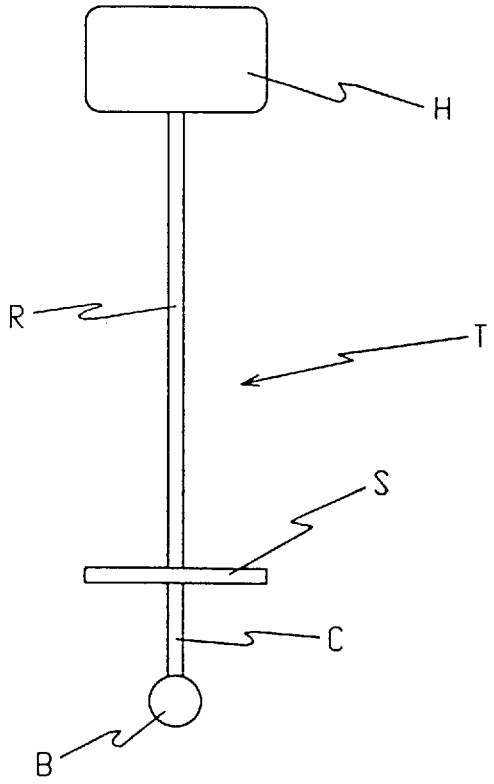
Fig. 5 PRIOR ART
FIG. 5 is a front view of a conventional tag pin.

Referring to FIG. 4, there is shown a second preferred embodiment of the present invention. Here, there is provided only one guide rail 26 having a pair of magnets 27*a* and 27*b* formed on opposite sides thereon. The finger member 41 mounted on the elevating plate 40 has a pair of magnetic protrusions 45*a* and 45*b* respectively corresponding to the magnets 27*a* and 27*b* of the guide rail 26.

With the above structure, the elevating plate 40 moves up and down as in the first embodiment. When the elevating plate 40 is in an upward position, the front side magnetic protrusion 45*a* is located at the upper magnet 27*a*, and when the elevating plate 40 is in a downward position, the back side magnetic protrusion 45*b* is located at the lower magnet 27*b*. Accordingly, the finger member 41 is moved in forward and reverse directions to feed the tag pins T as in the first embodiment.

In the tag pin attacher structured as in the above, the four-stepped movement of the finger member is accomplished using a simple structure of the elevating plate, guide rails, and a pair of magnets which allow the precise feeding of tag pins to be extruded regardless of the size of the pitch. As a result, the number of parts used in the attacher is reduced and the manufacturing process is made easy such that productivity is greatly improved.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A tag pin attacher, comprising:

an elevating plate disposed in a cavity in one of two sections of a casing;

a finger member mounted able to move forward and backward on the elevating plate to feed tag pins for extrusion, the elevating plate being moved up and down by rectilinear movement of an interconnector moving by operation of a trigger;

a guide rail part formed in the cavity of the casing, the guide rail part guiding the up and down movement of the elevating plate;

a pair of magnets formed on the guide rail part, each at differing heights; and a magnetic protrusion member formed at a predetermined position on the finger member such that the finger member can undergo a forward and reverse movement by being attracted to different magnets of the guide rail part with the up and down movement of the elevating plate.

2. The tag pin attacher of claim 1, wherein the magnetic protrusion member comprises a pair of magnetic protrusions, each formed on the finger member at differing positions along a longitudinal direction.

3. The tag pin attacher of claim 1, wherein the guide rail part comprises at least one guide rail formed in the cavity of the casing, the at least one guide rail having formed thereon, the pair of magnets, each at differing positions along a longitudinal direction.

* * * * *